US006126079A

United States Patent [19]

Shoemaker

[11] Patent Number: 6,126,079

[45] Date of Patent: Oct. 3, 2000

[54] FAN CONTROL

[75] Inventor: Jim Milton Shoemaker, Horicon, Wis.

[73] Assignee: Deere & Company, Moline, Ill.

[21] Appl. No.: 09/354,045

[22] Filed: Jul. 15, 1999

[51] Int. Cl.[7] ..... F01P 7/02

[52] U.S. Cl. ..... 236/35; 123/41.12

[58] Field of Search ..... 236/35, 46 R, 236/46 A, 46 F, 78 C, 78 D; 123/41.02, 41.11, 41.12; 165/299

[56] References Cited

U.S. PATENT DOCUMENTS

| | | | |
|---|---|---|---|
| 4,425,766 | 1/1984 | Claypole | 123/41.12 X |
| 4,487,255 | 12/1984 | Bianchetta et al. | 165/229 X |
| 4,955,431 | 9/1990 | Saur et al. | 236/35 X |
| 5,718,373 | 2/1998 | Kim et al. | 236/35 |

FOREIGN PATENT DOCUMENTS

WO98/09025 5/1998 Japan .

OTHER PUBLICATIONS

Walker Mowers web pages printed Jul. 7, 1999, two pages.

*Primary Examiner*—Harry B. Tanner

[57] ABSTRACT

A fan control system for a vehicle cooling system includes forward and reverse relays connected to a microprocessor based timer control. A third relay is controlled by a single temperature responsive switch or thermostat and selects either the high speed or low speed winding of an electric radiator fan or similar engine cooling device dependent on the temperature sensed by the thermostat. The thermostat also provides an input to the timer control to adjust or interrupt preselected timing functions for certain fan conditions. Upon start-up of the engine, the control initiates a first delay period during which the fan is maintained in the off condition regardless of the temperature of the coolant. After the initial delay, a second and longer delay period is initiated to maintain the fan in the off condition provided the sensed temperature remains below a preselected level.

22 Claims, 2 Drawing Sheets

FAN CONTROL

BACKGROUND OF THE INVENTION

1) Field of the Invention

The present invention relates generally to cooling systems, and more specifically to a fan control for controlling speed and direction of an electric radiator fan or similar cooling device.

2) Related Art

Off-road vehicles typically include electric fans to cool a radiator through which engine coolant circulates. Harsh environmental conditions result in build-up of debris on the radiator, and fan reversing systems are available to briefly reverse the fan direction periodically to clean the radiator or fan filter screen of accumulated debris. Such systems often have analog timers to control fan reversal, but achieving the long time delays requires several timers and is expensive.

Additional fan controls including two or more thermostats are often provided to achieve low speed fan operation until the coolant temperature reaches a threshold temperature and higher speed operation when the temperature is above threshold. Such varying fan speed operation increases efficiency, reduces noise and reduces the engine, battery and alternator loads until after the engine has reached the normal operating speed. The additional thermostat or thermostats necessary for the multi-speed fan operation add cost and complexity to the system. In some systems, the fan will automatically start when cranking the engine if the coolant temperature is above a preselected temperature thereby increasing drain on the battery during starting and adding load on the engine and alternator before the engine reaches normal operating speed.

SUMMARY OF THE INVENTION

It is therefore an object of the present invention to provide an improved fan control which overcomes most or all of the aforementioned problems. It is another object to provide such a control which is relatively simple and inexpensive in construction and yet provides many or all of the features of more complex and expensive control systems. It is a further object to provide such a control which reduces noise and minimizes engine, battery and alternator loads at start-up prior to the engine reaching normal operating conditions. It is still another object to provide such a control which has a fan reversal feature so that accumulated debris on the radiator of filter screen is removed.

It is another object of the present invention to provide an improved fan control which achieves more than one fan speed without need for more than one thermostat. It is a further object to provide such a control which reduces battery and alternator loading during and immediately following start-up. It is yet another object to provide such a control which simulates multi-thermostat operation with only one thermostat. It is a further object to provide such a circuit which advantageously utilizes the single thermostat as an input to a timer control.

It is a further object of the present invention to provide an improved cooling system motor control which is simple and reliable in construction. It is a further object to provide such a control which eliminates the need for expensive analog timers and multiple heat responsive switches and yet which provides similar control functions as circuits with these elements. It is still another object to provide such a control which advantageously utilizes relays in a unique configuration for controlling motor direction and speed.

A motor control constructed in accordance with the teachings of the present invention includes forward and reverse relays connected to a microprocessor based timer control. A third relay is controlled by a single temperature responsive switch or thermostat and selects either the high speed or low speed winding of an electric radiator fan or similar engine cooling device dependent on the temperature sensed by the thermostat. The thermostat also provides an input to the timer control to adjust or interrupt preselected timing functions for certain fan conditions.

Upon start-up of the engine, the control initiates a first delay period, preferably about twenty seconds, during which the fan is maintained in the off condition regardless of the temperature of the coolant. This initial fan off period reduces battery drain on start up, reduces noise, and reduces engine load a few moments until the engine has stabilized. After the initial delay, a second and longer delay period is initiated to maintain the fan in the off condition provided the sensed temperature remains below a preselected level.

These and other objects, features and advantages of the present invention will become apparent to one skilled in the art upon reading the following detailed description in view of the drawings.

DESCRIPTION OF THE PREFERRED EMBODIMENTS

Figure 1:
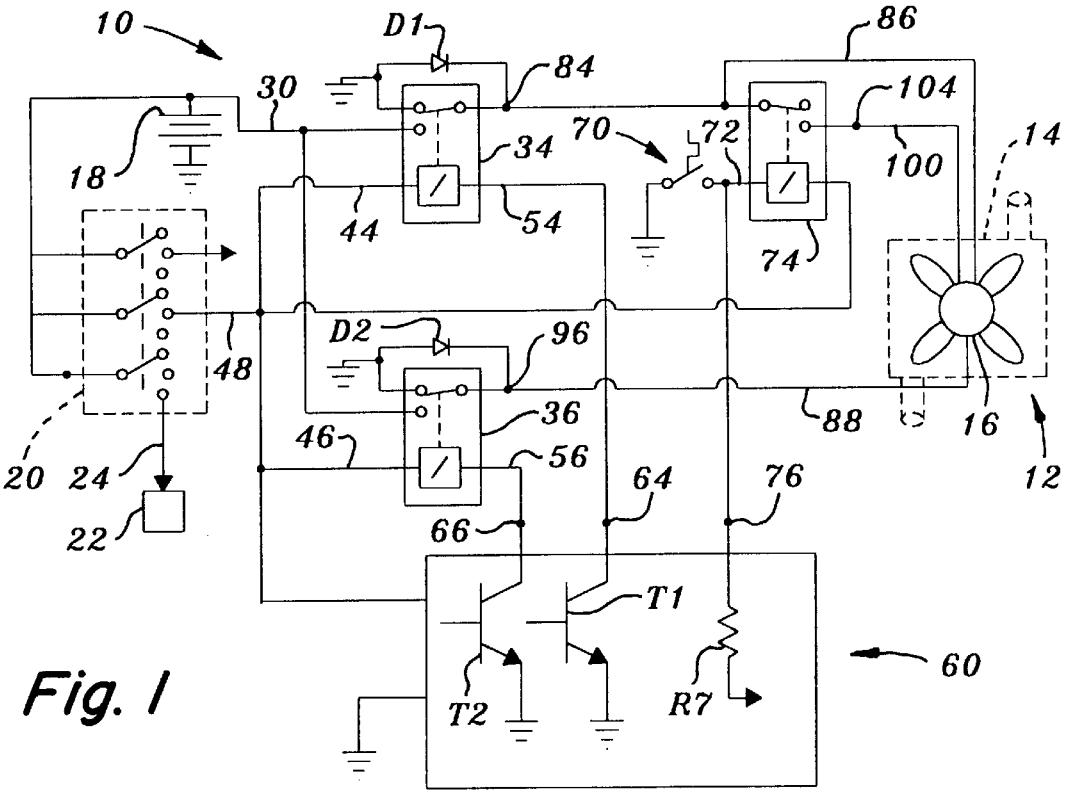
FIG. 1 is a schematic of a fan control circuit.
Figure 2:
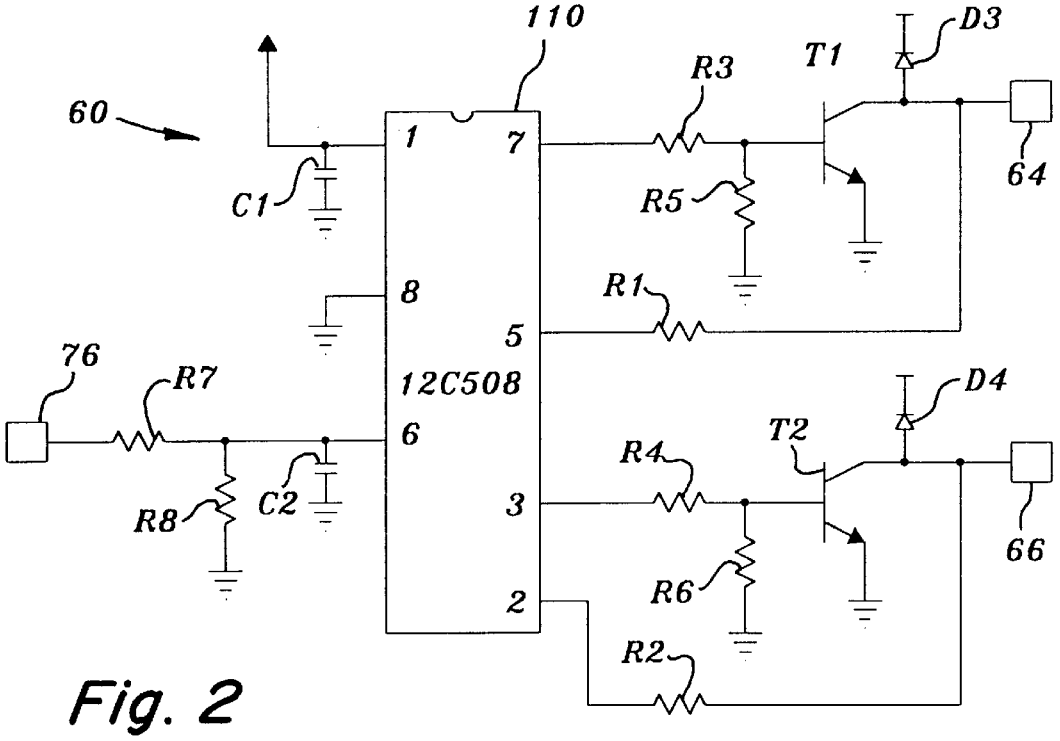
FIG. 2 is a schematic of the fan timer module for the circuit of FIG. 1.

Referring now to FIG. 1, therein is shown a fan control circuit 10 for a cooling system of a vehicle indicated generally at 12. The cooling system 12 includes a radiator 14 and an electrically driven fan 16 for blowing air through the radiator to remove heat from coolant circulating in the radiator. The fan 16 is reversible and as shown has at least two speeds including a low speed and a high speed. The vehicle includes a battery 18 connected to a conventional key switch 20 having off, on and start positions. A starter 22 for the vehicle engine is connected to a start terminal on the key switch 20.

The positive (B+) terminal of the battery 18 is connected via line 30 to one of a pair of input terminals on forward and reverse relays 34 and 36, respectively. The other input terminal of each of the relays is connected to ground. The relays 34 and 36 include first control terminals 44 and 46 connected to the respective relay coils and to a switched output terminal 48 on the key switch 20. The relay coils have second terminals 54 and 56 connected to a timing control module 60 via forward and reverse terminals 64 and 66. The switched output terminal 48 is also connected to one terminal 72 of a thermostat or temperature controlled switch 70 through a coil of a speed control relay 74. The switch 70 is open when the coolant is below a preselected temperature, preferably about 180 degrees, and closes when the coolant rises above this temperature. The other terminal of the switch 70 is connected to ground so the relay 74 is activated when the temperature rises above the preselected level. The terminal 72 is also connected to the control module 60 via terminal 76 so the terminal 76 is high when the switch 70 is open and low when the switch 70 is closed.

The forward relay 34 includes an output terminal 84 connected directly to low speed input line 86 of the fan 16.

A return line 88 from the fan 16 is connected to terminal 96 of the reverse relay 36. The fan 16 also includes a high speed input line 100 connected to the switched terminal 104 of the speed control relay 74. Diodes D1 and D2 connected between ground and the relay terminals 84 and 96 protect against large reverse voltage spikes caused by switching of the inductive fan motor load.

The timing control module 60 includes a microcontroller 110 having a terminal (1) connected to a source of power Vcc, preferably a five volt supply, and a terminal (8) connected to ground. A capacitor C1 is connected between the terminal and ground. The terminals 64 and 66 are connected to terminals 5 and 2 of the microcontroller 110 through resistors R1 and R2. Grounding NPN transistors T1 and T2 include collectors connected to the terminals 64 and 66 and bases connected to terminals 7 and 3 of the microcontroller through resistor R3 and R4 and to ground through resistors R5 and R6. Spike limiting diodes D3 and D4 are connected from the collectors of the transistors T1 and T2 to the battery 18. The microcontroller 110 briefly turns on the transistors T1 and T2 and checks the terminals 5 and 2 to monitor the collector-emitter voltages Vce of the transistors T1 and T2 via resistors R1 and R2. If a transistor output pin is erroneously connected directly to the battery 18 or there is a short to B+, a high Vce indicative of a saturation condition will be detected during the brief transistor test turn-on time, and the microprocessor 110 prevents any damaging prolonged turn-on of the transistor.

A resistor R7 connects the terminal 72 of the temperature controlled switch 70 to the input 6 of the microcontroller 110. A resistor R8 and capacitor C2 are connected in parallel between the input 6 and ground. When the coolant temperature reaches the preselected temperature (about 180 degrees), the switch 70 closes to ground the input terminal 76 and provide a temperature signal to the microcontroller 110. Closing of the switch 70 with the terminal 48 powered activates the speed control relay 74 to connect the high speed winding of the fan to power and facilitate high speed fan operation after a delay period upon engine start up. The fan 16 normally rotates in a forward direction to direct air through the radiator 14 in a first direction. For forward fan operation, the relay 34 is activated (T1 is turned on) to connect the positive terminal of the battery 18 directly to the low speed line 86 and to the speed control relay 74. The relay 36 remains inactivated (as shown in FIG. 1, with T2 in the off condition) to connect the return line 88 from the fan 16 to ground. For reverse operation of the fan 16, T2 is turned on and T1 is turned off so that the relay 34 is inactivated and 36 is activated, thereby powering the line 88 from the positive terminal of the battery 18.

Figure 3:
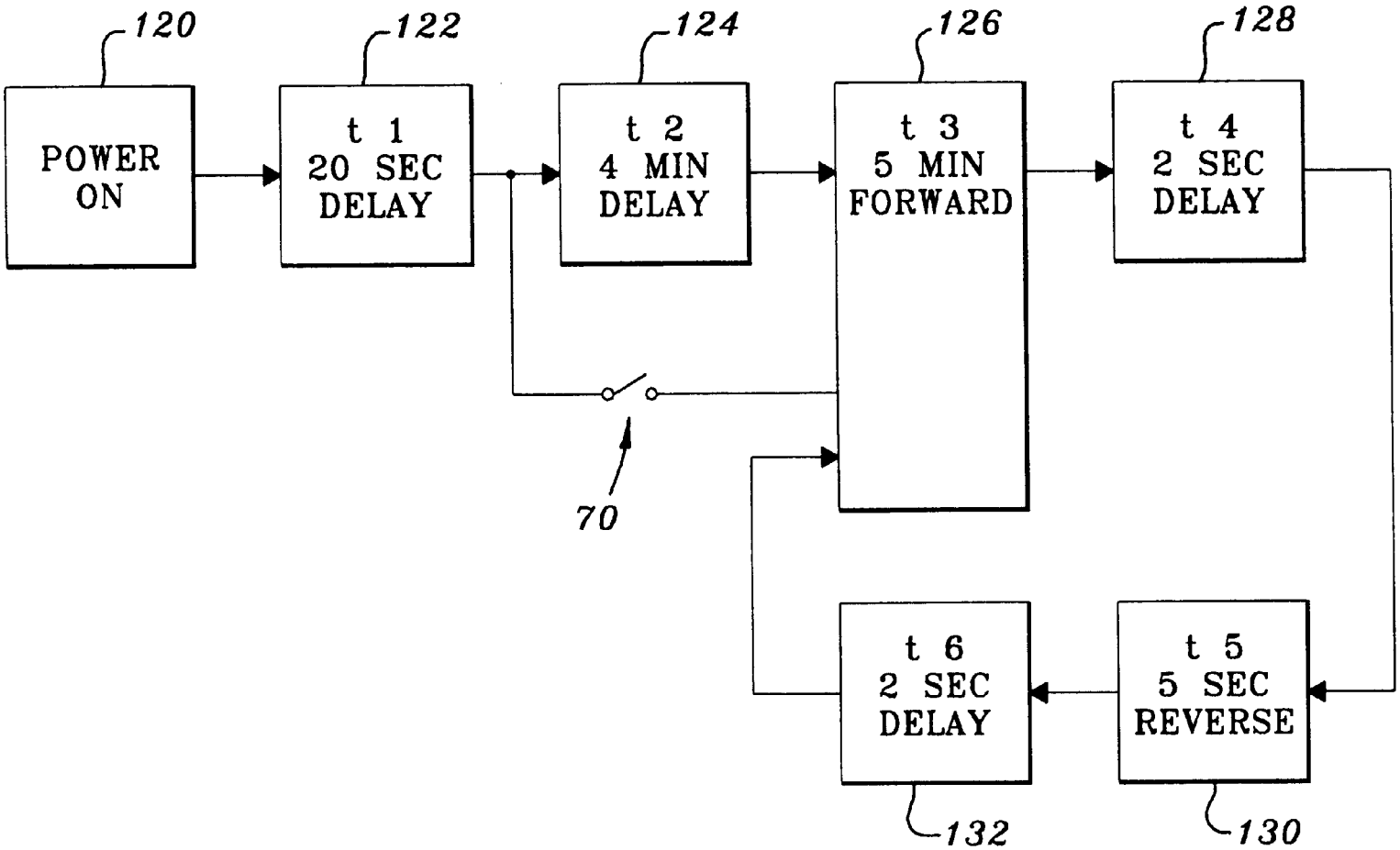
FIG. 3 is a logic diagram for the fan control circuit of FIG. 1.

The microcontroller 110 evaluates vehicle starting, accumulated engine running time, and coolant temperature to automatically control fan turn on and turn off, fan speed and fan direction. To provide full battery power for start up of the engine, reduce engine loads during the first few moments of engine operation until operation has stabilized, and reduce noise, the control module prevents fan operation during a first delay (122 of FIG. 3) after power up (120), regardless of the state of the temperature controlled switch 70. At power up 120, the microcontroller maintains the transistors T1 and T2 in the off condition (terminals 7 and 3 are low) for the period t1, preferably about 20 seconds, so that the lines 84, 86 and 88 are grounded through the relays 34 and 36 and the fan 16 remains unpowered. Assuming the temperature of the coolant is below the preselected temperature so the switch 70 is open, the controller establishes a second period t2 (see 124 of FIG. 3), which preferably is approximately four minutes, wherein the fan 16 is retained in the off condition. During the period t2, the microcontroller 110 senses state of the switch 70 by monitoring input 6. If coolant temperature rises above the preselected level so the input 6 goes low, the microcontroller 110 sets the terminal 7 high to turn on the transistor T1 and activate the forward relay 34 so the fan 16 begins to operate. If the switch 70 remains open, the microcontroller 110 sets the terminal 7 high to turn on the forward relay 34 and activate the fan 16 for a period t3 (126 of FIG. 3) which preferably is approximately five minutes. Fan speed is determined by the condition of the switch 70. If the switch 70 is closed, the fan speed relay 74 will activate to connect power to the high speed input line 100. If the coolant temperature then cools below the threshold temperature so that the switch 70 opens, the relay 74 will deactivate so only the low speed input line 86 is energized and the fan will run at the slow speed until the switch 70 closes with rising coolant temperature. The initial off periods and low speed fan operation while the coolant is below the preselected temperature reduces noise and power requirements and provides the impression and advantages of a system having at least two thermostatic switches with only a single switch 70.

After the period t3 (126), the microprocessor initiates a short routine for reversing the fan 16 to reverse the direction of airflow through the radiator 14 to help clear any debris that may have accumulated. First, power to the fan 16 is cut off for a short period (see t4 of 128), preferably about two seconds so the fan stops, by setting the terminals 7 and 3 of the microcontroller 110 low to turn off the transistors T1 and T2 to deactivate the relays 34 and 36. After the delay t4, the fan 16 is operated in the reverse condition for a period t5 (see 130 of FIG. 3) as the microcontroller 110 sets the terminal 3 to high to turn on the transistor T2, activating the reverse relay 36 and supplying battery power to the line 88. The fan 16 runs in reverse to clear debris from the radiator 14 (or from the fan filter or similar debris-accumulating structure).

After the period t5, which preferably is about five seconds, the microcontroller 110 again sets the terminals 7 and 3 to the low condition so the relays 34 and 36 are deactivated and the fan 16 is unpowered for a period t6 (132 of FIG. 3) and stops. After the period t6, the fan is again run in the forward direction for the period t3 at 126. The forward—reverse cycle 126–132 is continued until vehicle shut-down or interruption of power for any reason.

By way of example only, the following component values have been found to provide reliable operation:

| | |
|---|---|
| R1, R2 | 10 k ohms |
| R3 through R8 | 1 k ohms |
| C1, C2 | .01 uf |
| Microprocessor 111 | PIC12C508 available from Microchip Technology Inc. |

Having described the preferred embodiment, it will become apparent that various modifications can be made without departing from the scope of the invention as defined in the accompanying claims.

What is claimed is:

1. A cooling system for a vehicle having an engine, an electrical system, and a starter system activatable to start the engine, the cooling system comprising:

a radiator including circulating coolant fluid;

a temperature sensor providing a signal dependent upon sensed temperature of a coolant fluid;

an electrically operated variable speed cooling device having a plurality of operating conditions and connected to the electrical system;

a control operably connected to the cooling device and the temperature sensor; and wherein the control includes a timing circuit providing first and second time periods, the control establishing a first device operating condition for the first time period after starting of the engine, a second device operating condition for the second time period after the first period, and a third operating condition after the second period.

2. The system as set forth in claim 1 wherein the first operating condition is an off condition for limiting cooling device noise and engine load during and immediately after starting of the engine.

3. The system as set forth in claim 2 wherein the second operating condition is also an off condition and wherein the control is responsive to the temperature sensor signal to interrupt the second time period to start cooling device operation if the signal indicates a temperature above a preselected level.

4. The system as set forth in claim 1 wherein the first operating condition is an off condition, and the third operating condition is a full speed condition if sensed temperature is above a preselected temperature and an intermediate speed condition if the sensed temperature is below the preselected temperature.

5. The system as set forth in claim 4 wherein the first time period is a first fixed period of time, the second time period is normally a second fixed period of time, and the control is responsive to the sensed temperature to shorten the second time period in response to the sensed temperature exceeding the preselected temperature.

6. The system as set forth in claim 5 wherein the temperature sensor comprises a single heat activated switch.

7. The system as set forth in claim 1 wherein the variable speed cooling device comprises a reversible fan and the third operating condition comprises a fan speed condition with rotation of the fan in a first direction, the control circuit also providing a fourth operating condition wherein rotation of the fan is in a direction opposite the first direction to thereby help remove debris from the radiator.

8. The system as set forth in claim 7 wherein the control circuit provides the third operating condition for a third time period substantially greater than the second time period.

9. The system as set forth in claim 8 wherein the third time period is substantially greater than the time the fan is rotated in the direction opposite the first direction.

10. The system as set forth in claim 7 wherein the second operating condition comprises a fan off condition, and wherein the first operating condition comprises a fan off condition to reduce engine loading and noise immediately after the engine is started.

11. A cooling system for a vehicle having an engine and a starter system activatable to start the engine, the cooling system comprising:

a radiator including circulating coolant fluid;

an electrically operated variable speed fan rotatable in forward and reverse directions;

a control operably connected to the fan for controlling the speed and direction of the fan;

a temperature sensor providing a coolant temperature signal to the control; and the control providing a zero speed fan operation for first and second delay periods after the engine is started and forward speed operation after the second delay period, the second delay period having a preselected maximum length, and wherein the control is responsive to the coolant temperature signal to shorten the second delay period if the coolant temperature exceeds a preselected maximum temperature prior to termination of the second delay period.

12. The system as set forth in claim 11 wherein the temperature sensor comprises a single switch having a first condition when the coolant temperature is below the preselected maximum temperature and a second condition when the coolant temperature is above the preselected maximum temperature.

13. The system as set forth in claim 12 wherein the control is responsive to the second condition of the single switch to provide forward fan operation before the end of the delay period.

14. The system as set forth in claim 11 wherein the control delays operation of the fan for the first delay period time regardless of the coolant temperature signal to reduce noise and engine load immediately after the engine is started.

15. The system as set forth in claim 14 wherein the first delay period is approximately twenty seconds, and the preselected maximum length is approximately four minutes, and wherein fan speed after the second delay period is dependant on the coolant temperature signal.

16. The system as set forth in claim 11 wherein the control includes a fan reversing circuit to reverse the fan for a period of time to help clear debris from the radiator.

17. A cooling system for a vehicle having an engine and a starter system activatable to start the engine, the cooling system comprising:

a radiator including circulating coolant fluid;

an electrically operated variable speed radiator fan rotatable in forward and reverse directions;

a control operably connected to the fan to control the speed and direction of the fan;

a temperature sensor providing a coolant temperature signal to the control;

the control providing fan operation in the forward direction after a delay period after the engine is started, the delay period dependent upon the coolant temperature signal; and wherein the control provides temporary fan operation in the reverse direction to help clear debris from the radiator.

18. The system as set forth in claim 17 wherein the delay period has a preselected maximum length, and wherein the control is responsive to the coolant temperature signal to shorten the period if the coolant temperature exceeds a preselected maximum temperature.

19. The system as set forth in claim 18 wherein the control includes a timer establishing the delay period, and the temperature sensor comprises a single temperature responsive switch having an open and a closed condition, wherein the control is responsive to a change in condition of the switch to shorten the delay period in response to the coolant temperature rising above a preselected temperature.

20. The system as set forth in claim 19 wherein the delay period has a preselected minimum length independent of the switch condition to temporarily reduce noise and engine load immediately after the engine is started.

21. The system as set forth in claim 17 including reversing relay structure connected to the fan and a fan speed control relay connected to the fan, and wherein the control com prises a microprocessor controlled timer connected to the reversing relay structure and to the fan speed control relay and establishing the delay period.

22. The system as set forth in claim 21 wherein the temperature sensor comprises a switch having first and second terminals, the first terminal connected to ground and the second terminal connected to the fan speed control relay and to an input on the microprocessor.

* * * * *